US010448802B2

(12) United States Patent
Carrer et al.

(10) Patent No.: US 10,448,802 B2
(45) Date of Patent: Oct. 22, 2019

(54) PRESSURE TRANSDUCER AND ANTI-FLOOD DEVICE ASSEMBLY FOR AN APPARATUS, FOR EXAMPLE A WASHING MACHINE

(71) Applicant: ELBI INTERNATIONAL S.P.A., Turin (IT)

(72) Inventors: Giorgio Carrer, Turin (IT); Giuseppe Marone, Nichelino (IT); Marco Becchio, Carignano (IT); Paolo Ravedati, Moncalieri (IT)

(73) Assignee: ELBI INTERNATIONAL S.P.A., Turin (IT)

( * ) Notice: Subject to any disclaimer, the term of this patent is extended or adjusted under 35 U.S.C. 154(b) by 0 days.

(21) Appl. No.: 16/077,252

(22) PCT Filed: Feb. 2, 2017

(86) PCT No.: PCT/IB2017/050556

§ 371 (c)(1),
(2) Date: Aug. 10, 2018

(87) PCT Pub. No.: WO2017/137870

PCT Pub. Date: Aug. 17, 2017

(65) Prior Publication Data

US 2019/0045999 A1 Feb. 14, 2019

(30) Foreign Application Priority Data

Feb. 10, 2016 (IT) ..... 10201613616

(51) Int. Cl.
*A47L 15/42* (2006.01)
*D06F 39/08* (2006.01)

(52) U.S. Cl.
CPC ..... *A47L 15/421* (2013.01); *D06F 39/081* (2013.01); *D06F 39/087* (2013.01)

(58) Field of Classification Search
None
See application file for complete search history.

(56) References Cited

U.S. PATENT DOCUMENTS 4,810,306 A * 3/1989 Noren ..... A47L 15/0002 134/103.1
5,028,910 A 7/1991 Meacham et al.
(Continued)

FOREIGN PATENT DOCUMENTS

DE 3430639 A1 3/1986
DE 4101763 A1 7/1992
WO 2010/023302 A1 3/2010

OTHER PUBLICATIONS

International Search Report and Written Opinion from International Application No. PCT/IB2017/050556, dated May 2, 2017.

*Primary Examiner* — Fekadeselassie Girma
(74) *Attorney, Agent, or Firm* — Merchant & Gould P.C.

(57) ABSTRACT

An assembly includes a transducer and anti-flood device. The transducer receives, as an input, a pressure signal taken by a liquid held in a main container and includes a circuit, for providing, as an output, an electric control signal having a variable parameter representing the pressure signal. The anti-flood device includes a receptacle, a float and a sensor. The receptacle is arranged to receive and hold a part of liquid coming from the secondary container. The float is movably mounted in the receptacle and moves up to a height representing the level reached by the part of liquid. The sensor is configured to detect the height reached by the float and to transmit an electric level-indicating signal representing the height to the circuit. The circuit is designed to apply, to the variable parameter, a correction that is determined as a function of the level-indicating signal according to predetermined criteria.

6 Claims, 3 Drawing Sheets

(56) References Cited

U.S. PATENT DOCUMENTS

| | | | | | |
|---|---|---|---|---|---|
| 5,398,517 | A * | 3/1995 | Poindexter | B01D 5/0039 | 62/125 |
| 5,615,832 | A * | 4/1997 | Price | B05B 7/1404 | 137/489.5 |
| 5,964,326 | A * | 10/1999 | Lee | B60T 17/222 | 188/352 |
| 2003/0201187 | A1* | 10/2003 | Speranza | C25B 1/10 | 205/252 |
| 2005/0061394 | A1* | 3/2005 | Awad | B60T 17/222 | 141/98 |
| 2009/0217753 | A1* | 9/2009 | Burris | G01F 23/2962 | 73/290 V |
| 2010/0105128 | A1* | 4/2010 | Rezin | C02F 3/1242 | 435/262.5 |
| 2011/0036779 | A1* | 2/2011 | Bias | B03D 1/1418 | 210/703 |
| 2013/0193049 | A1* | 8/2013 | Urban | B01D 35/00 | 210/181 |
| 2014/0007878 | A1* | 1/2014 | Armitstead | A61B 5/083 | 128/204.23 |
| 2015/0074893 | A1* | 3/2015 | Veros | E03D 5/105 | 4/313 |
| 2016/0123788 | A1* | 5/2016 | Farmanyan | G01F 23/62 | 73/317 |
| 2018/0047106 | A1* | 2/2018 | Snyder | G06Q 40/08 | |
| 2018/0053508 | A1* | 2/2018 | Agnew | A61H 33/6005 | |
| 2018/0093825 | A1* | 4/2018 | Young | F17C 3/10 | |

* cited by examiner

PRESSURE TRANSDUCER AND ANTI-FLOOD DEVICE ASSEMBLY FOR AN APPARATUS, FOR EXAMPLE A WASHING MACHINE

This application is a National Stage Application of International Application No. PCT/IB2017/050556, filed 2 Feb. 2017, which claims benefit of Ser. No. 102016000013616, filed 10 Feb. 2016 in Italy and which applications are incorporated herein by reference. To the extent appropriate, a claim of priority is made to each of the above-disclosed applications.

TECHNICAL FIELD

The invention relates to a pressure transducer and anti-flood device assembly for an apparatus, for example a washing machine.

TECHNOLOGICAL BACKGROUND

Household appliances, such as washing machines (for example laundry machines or dishwashers) are usually provided with an anti-flood safety device, which generally fulfills the function of signaling liquid leaks in a main container (for example a washing tank of a washing machine) and is separate from a pressure transducer, which is typically used as a level sensor for the liquid contained in the main container.

SUMMARY OF THE INVENTION

An object of the invention is to provide a pressure transducer and anti-flood device assembly, which is improved relative to the ones of the prior art and, at the same time, can be produced in a simple and economic manner.

According to the invention, this and other objects are reached by means of an assembly having the technical features set forth in appended independent claim.

As a matter of fact, according to the invention, the aforesaid assembly is capable of transmitting information on possible liquid leaks from a main container of an apparatus (for example a household appliance, such as a washing machine, typically a dishwasher or a laundry machine) through a same electric control signal indicating the pressure—and therefore the level—of the liquid housed in the main container of the apparatus (for example the washing tank of a washing machine).

The appended claims are an integral part of the technical teachings provided in the following detailed description concerning the invention. In particular, the appended dependent claims define some preferred embodiments of the invention and describe optional technical features thereof.

Further features and advantages of the invention will be clearly understood from the following detailed description, which is given by way of non-limiting example, with reference, in particular, to the accompanying drawings, which are briefly described below.

DETAILED DESCRIPTION OF THE INVENTION

Figure 1:
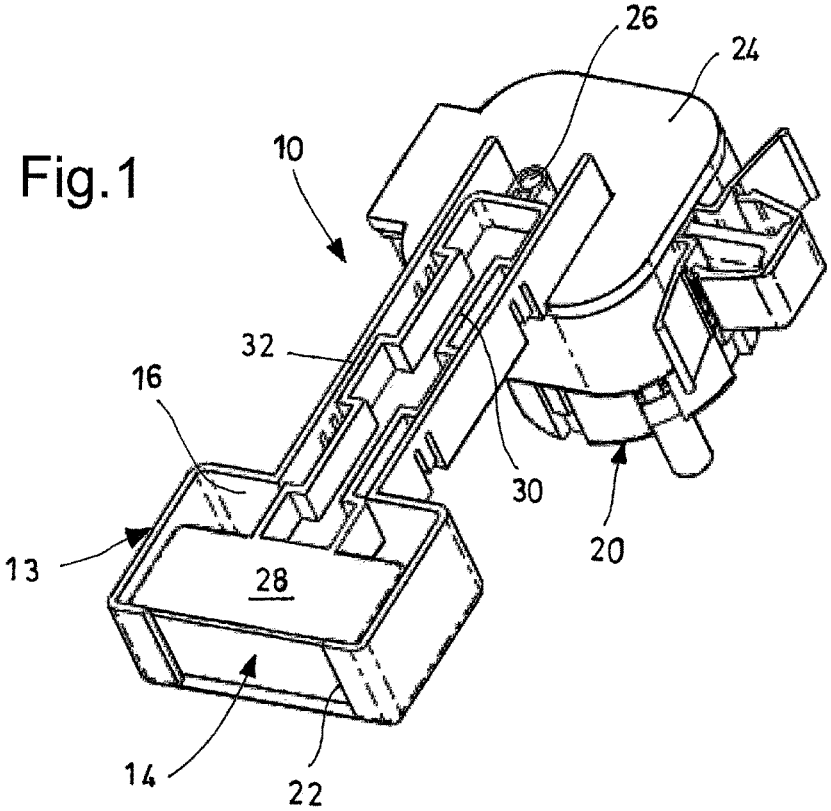
FIGS. 1 and 2 are perspective views showing two operating positions of a pressure transducer and anti-flood device assembly according to an exemplary embodiment of the invention.
Figure 2:
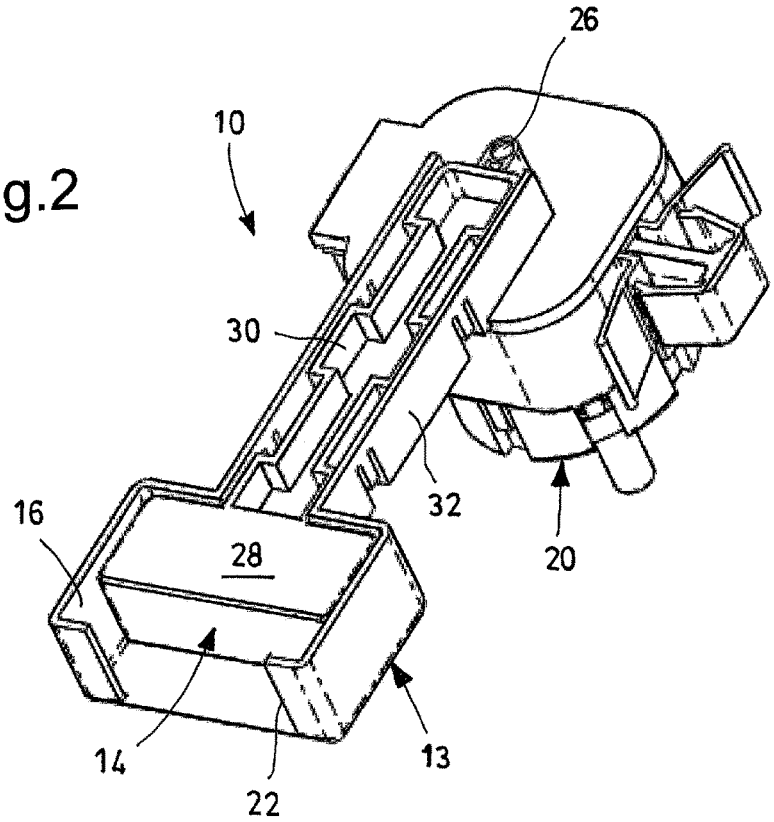

With reference, in particular, to FIGS. 1 to 6, number 10 indicates, as a whole, a pressure transducer and anti-flood device assembly, which is manufactured according to an explanatory embodiment of the invention.

The assembly 10 is suited to be used in a plurality of different applications. In the embodiment show herein, the assembly is suited to be used in an apparatus, for example a household appliance. More in particular, said household appliance can be a washing machine (for example a laundry machine or a dishwasher).

In particular, though not exclusively, the assembly 10 can be used to monitor the pressure—and, therefore, through it, the level—of a liquid contained in a main container, for example the washing tank 11 of the washing machine. At the same time, the assembly 10 is designed to control possible liquid leaks of the main container 11 through the level of the liquid received by a secondary container 12, which is in fluid communication with the main container. However, as a person skilled in the art clearly understands, the apparatus can be of a different type from the one indicated above (for example a drying machine) as well as the container can be different from a washing tank.

The assembly 10 comprises a pressure transducer 20, which is configured to detect a pressure signal Sp—which indicates the level—of a liquid situated in the washing tank 11 of the washing machine.

The transducer 20 is configured to receive, as in input, the aforesaid (physical) pressure signal Sp and to provide, as an output, an electric signal Sc having a variable parameter (for example modulated in amplitude, frequency, phase or by means of PWM), which is determined based on the aforesaid pressure signal Sp.

As a person skilled in the art can easily understand, said transducer 20 can be of any known type, for example, a magnetic, capacitive, piezoresistive transducer, which, therefore, will not be described in detail hereinafter. However, by way of example, the assembly 10 can use the transducer described in Italian patent no. 1337356, owned by the Applicant, which uses an inductive sensor provided with an oscillator, for example of the Colpitts type, and a signal processing microprocessor.

Furthermore, the assembly 10 comprises an anti-flood device 13, which, in turn, comprises a float 14 and a receptacle 16 wherein the float 14 is movably mounted. The receptacle 16 is intended to be inserted into the secondary container 12, which collects the liquid of the possible leak from the washing tank 11. The float 14 is arranged to move to a height representing the level of the liquid inside the secondary container 12.

Figure 4:
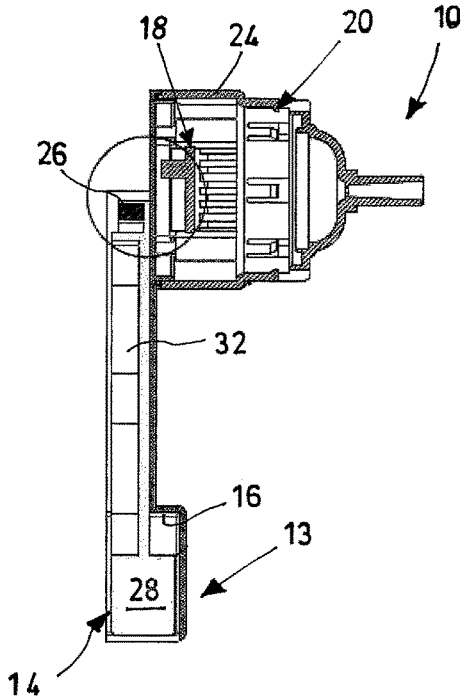
Figure 6:
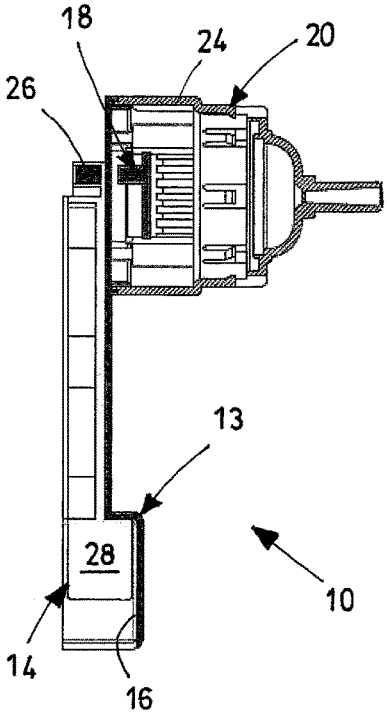

Furthermore, with reference, in particular, to FIGS. 4 and 6, the anti-flood device 13 also has a sensor 18, which is configured to detect the height reached by the float 14 in the receptacle 16.

The sensor 18 is further configured to transmit an electric level-indicating signal S1, which represents the height reached by the float 14. In the embodiment shown herein, the electric level-indicating signal S1 indicates that the height of the float 14 has exceeded a predetermined threshold value. Said threshold value indicates the presence of liquid leaks occurred in the washing tank 11, which have flown into the secondary container 12.

As described more in detail below, the assembly 10 is configured to process the information detected by the transducer 20 and by the sensor 18, so that said assembly 10 provides, as an output, a control signal Sc addressed to a control unit (or control board) of the washing machine.

Figure 7:
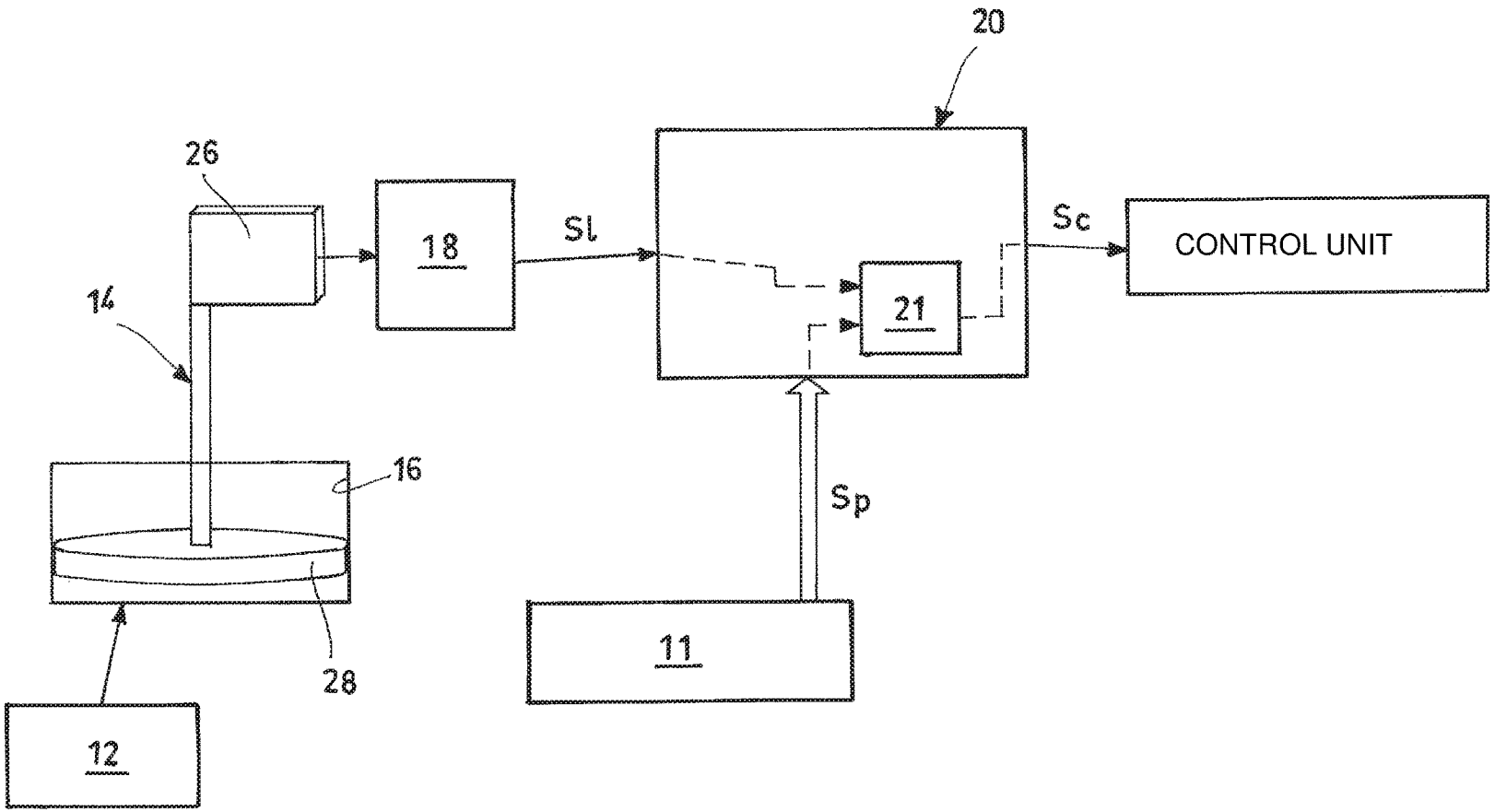
FIG. 7 is a schematic flowchart showing the functional components of the assembly shown in the previous figures.

With reference, in particular, to FIG. 7, it can be seen a flowchart, which shows the functional elements belonging to the assembly 10 manufactured according to an explanatory embodiment of the invention.

In the assembly 10 shown in FIG. 7, the transducer 20 receives, on the one hand, the pressure signal Sp coming from the washing tank 11 and, on the other hand, the level signal S1 coming from the sensor 18.

The transducer 20 further comprises circuit means 21, which are configured to process and provide, as an output, an electric control signal Sc having a variable parameter indicating the pressure of the liquid contained in the washing tank 11, though subjected to a correction which is determined based on the level-indicating signal S1, according to predetermined criteria.

According to an explanatory embodiment of the invention, these criteria include a fixed and predetermined correction, which is applied only if the level-indicating signal S1 indicates that the aforesaid threshold value relating to the height reached by the float 14 has been exceeded. For example, the applied correction can be equal to an increase of a significant value or a remarkable amplification of the value of the variable parameter that—in normal conditions—would be due to the sole pressure signal Sp. By so doing, the variable parameter expressed by the control signal Sc is altered in a significant manner, so that the control unit (not shown) of the washing machine is capable of immediately interpreting it as a faulty flood condition.

According to further variants, said criteria include a correction that depends on and is substantially commensurate with the height detected by the sensor 18 by means of the level-indicating signal S1. In other words, in said further variants, the greater the value of a variable parameter (for example modulated in amplitude, frequency, phase or by means of PWM) associated with the level-indicating signal S1, the greater the extent of the correction applied to the electric control signal Sc.

The control signal Sc can be modulated according to different techniques, for example in amplitude, frequency, phase, or with pulse-width modulation (PWM). Furthermore, the control signal Sc can be transmitted by means of different communication modes and channels, for example by means of serial transmission.

As already mentioned above, the receptacle 16 is typically installed in the secondary container 12 designed to collect the possible main liquid leaking from the washing tank 11 and has an opening 22 located under the float 14. Through the opening 22, the liquid contained in the secondary container 12 can flow inside and push the float 14 upwards.

In the embodiment shown herein, the receptacle 16 is fixed to the casing 24 of the transducer 20.

In the embodiment shown herein, the circuit means 20 are contained inside the casing 24.

Preferably, the circuit means comprise an oscillator 20*a*, for example an inductive one (such as a Colpitts oscillator), and a microprocessor 20*b*, which cooperate with one another so as to process and produce, as an output, the electric control signal Sc.

Preferably, the sensor 18 is housed inside the casing 24 of the transducer 20.

In the embodiment shown herein, the float 14 comprises an activator element 26 integral thereto, whereas the sensor 18 is a proximity sensor capable of being activated and emitting the level-indicating signal S1 when the activator element 26 is close to it, thus causing it to switch. As a person skilled in the art clearly understands, the sensor 18 can be any type of electronic proximity sensor (for example a magnetic, inductive, capacitive, field-effect sensor) or any type of electromechanical proximity sensor (for example a switch or a microswitch). In the last case concerning the electromechanical sensor, the interaction between the activator element and the sensor is mechanical (for example by means of an interference or a thrust exerted by the activator upon a movable member of the sensor).

Preferably, the sensor 18 is a magnetic proximity sensor (for example a Hall effect sensor or a Reed switch) and the activator element 26 is a permanent magnet cooperating with the sensor 18 in order to make it switch when the float 14 moves to an alert position corresponding to a height at which the likelihood of a water leak in the washing machine is high.

In the embodiment shown herein, the float 14 has a widened end 28 and a narrow stem 30 (for example an internally hollow one), which carries the activator element 26, for example in the area of its top.

In the embodiment shown herein, the float 14 is supported with freedom of sliding and in a guided manner relative to the casing 24, in particular by means of a support structure connected to the latter. For example, the aforesaid support structure comprises a pair of side walls 32, which define a gap, which houses, with freedom of movement, the narrow stem 30.

In the embodiment shown herein, the float 14 is movable next to the casing 24 of the transducer 20. Preferably, the side walls 32 are fixed to the casing 24 in such a way that the float 14 can be moved along an outer wall of the casing 24.

In the embodiment shown herein, the assembly 10 comprises a wall (not shown for the sake of the simplicity of the description), which closes at the front (for those observing FIGS. 1 and 2) the receptacle 16 and the side walls 32.

Hereinafter it will be described an exemplary operating mode of the assembly 10 with reference to FIGS. 1 to 6.

Figure 3:
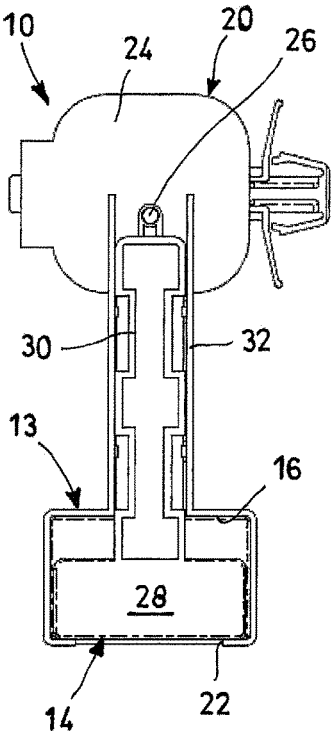
FIGS. 3 and 4 are a side elevation view and a front view with a longitudinal section of the assembly shown in FIG. 1.

In FIGS. 1, 3 and 4, the float 14 is in a lowered or rest condition, in which there is no liquid in the receptacle 16 and, therefore, there is no flood in the washing machine.

In this condition, the activator element 26 is in a remote position relative to the sensor 18, which does not switch and does not transmit any level signal S1.

The circuit means 21, in the meantime, process the pressure signal Sp and—as they do not receive any level signal S1—transmit the electric control signal Sc without subjecting the variable parameter to any correction.

Hence, the control unit of the washing machine receives the control signal Sc and, as the latter does not have significant corrections, it is interpreted as a signal that simply carries an information concerning the level of the liquid in the washing tank 11.

When—following a leak in the washing tank 11—the level of the liquid in the secondary container 12 raises, the cavity of the receptacle 16 starts receiving liquid on the inside through the opening 22, thus causing the height of the float 14 to increase.

Figure 5:
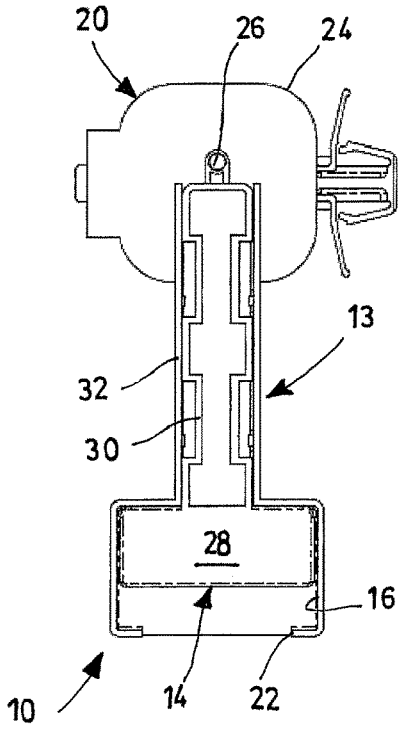
FIGS. 5 and 6 are a side elevation view and a front view with a longitudinal section of the assembly shown in FIG. 2.

If the level of liquid—for example due to a leak—raises beyond a threshold value in the secondary container 12, the receptacle 16 accordingly receives a quantity of water that is capable of causing the float 14 to reach a lifted or alert condition (corresponding to the predetermined threshold value), which is shown in FIGS. 5 and 6. In this condition, the float 14 has its activator element 26 (in this case, a magnet) in a position close to the sensor 18 (in this case, a magnetic proximity sensor). Therefore, the sensor 18 is activated and emits the level-indicating signal S1.

The circuit means 21, in the meantime, receive the pressure signal Sp and—at the same time—the level-indicating signal S1. Subsequently, the circuit means 20 process the control signal Sc, which is subjected to the correction (for example an additive or amplifying correction) due to the level signal S1, and transmit the control signal Sc to the control unit of the washing machine.

The control unit of the washing machine receives the control signal Sc and detects that the control signal Sc carries a modified information relative to the range of values that can be assumed from the variable parameter, which would only be associated with the pressure signal Sp in normal operating conditions. Therefore, the control unit interprets the control signal Sc as a signal that carries an alert information concerning the presence of a leak in the washing tank 11 of the washing machine.

By so doing, the control unit is capable of adopting the necessary countermeasures in its control of the devices of the washing machine, for example by deactivating the introduction of liquid into the washing tank.

Naturally, the principle of the invention being set forth, embodiments and implementation details can be widely changed relative to what described above and shown in the drawings as a mere way of non-limiting example, without in this way going beyond the scope of protection which is defined by the accompanying claims.

The invention claimed is:

1. A pressure transducer and anti-flood device assembly for an apparatus; said apparatus comprising a main container, for containing a quantity of liquid during use, and a secondary container in fluid communication with said main container; said assembly comprising a transducer having a casing and an anti-flood device;

said transducer receiving, as an input, a pressure signal taken by a liquid held in said main container and comprising a circuit, for providing, as an output, an electric control signal having a variable parameter representing said pressure signal;

said anti-flood device comprising:

a receptacle arranged for receiving and holding a part of liquid coming from said secondary container, a float movably mounted in said receptacle and arranged for moving up to a height representing a level reached by said part of liquid held in said receptacle, and a sensor detecting the height reached by said float in said receptacle and for transmitting an electric level-indicating signal representing said height to said circuit; wherein said sensor is a proximity sensor contained in said casing of said pressure transducer;

said circuit applying to said variable parameter, a correction which is determined as a function of the level-indicating signal according to predetermined criteria.

2. Assembly according to claim 1, wherein said sensor comprises an output including said electric level-indicating signal, when the height of said float exceeds a predetermined threshold value.

3. Assembly according to claim 2, wherein said circuit performs a fixed and predetermined correction, when said circuit receives said electric level-indicating signal.

4. Assembly according to claim 1, wherein said sensor comprises an output including an electric level-indicating signal having a parameter varying according to the height reached by the float.

5. Assembly according to claim 4, wherein in the variable parameter of said electric control signal, said circuit performs a depending correction as a function of a value assumed by the variable parameter of the electric signal.

6. Assembly according to claim 1, wherein said apparatus comprises a washing machine; and wherein said main container comprises a washing tank.

* * * * *